US012429065B2

(12) United States Patent
Gallina et al.

(10) Patent No.: US 12,429,065 B2
(45) Date of Patent: Sep. 30, 2025

(54) BLADE FOR A LOW-NOISE INDUSTRIAL AXIAL FAN, INDUSTRIAL AXIAL FAN AND PROCESS FOR MANUFACTURING A BLADE OF AN INDUSTRIAL AXIAL FAN

(71) Applicant: COFIMCO S.R.L., Pombia (IT)

(72) Inventors: Carlo Gallina, Pombia (IT); Alberto Manassa, Pombia (IT); Emanuele Torno, Pombia (IT)

(73) Assignee: COFIMCO S.R.L., Pombia (IT)

( * ) Notice: Subject to any disclaimer, the term of this patent is extended or adjusted under 35 U.S.C. 154(b) by 0 days.

(21) Appl. No.: 18/701,017

(22) PCT Filed: Oct. 13, 2022

(86) PCT No.: PCT/IB2022/059822
§ 371 (c)(1),
(2) Date: Apr. 12, 2024

(87) PCT Pub. No.: WO2023/062578
PCT Pub. Date: Apr. 20, 2023

(65) Prior Publication Data

US 2024/0401605 A1 Dec. 5, 2024

(30) Foreign Application Priority Data

Oct. 14, 2021 (IT) ..... 102021000026387

(51) Int. Cl.
*F04D 29/38* (2006.01)
*B21C 23/00* (2006.01)
(Continued)

(52) U.S. Cl.
CPC ..... *F04D 29/384* (2013.01); *B21C 23/002* (2013.01); *F04D 29/281* (2013.01); *F04D 19/002* (2013.01)

(58) Field of Classification Search
CPC ..... F04D 29/384; F04D 29/281; F04D 19/002
See application file for complete search history.

(56) References Cited

U.S. PATENT DOCUMENTS 6,814,545 B2 * 11/2004 Hext, III ..... F04D 29/384 416/DIG. 5
8,851,851 B2 * 10/2014 Moore ..... F04D 29/663 416/241 A (Continued)

FOREIGN PATENT DOCUMENTS

| | | |
|---|---|---|
| JP | H03 110199 | 11/1991 |
| KR | 2014 0001366 | 3/2014 |
| WO | 2017/085134 | 5/2017 |

OTHER PUBLICATIONS

International Search Report and Written Opinion, European Patent Office, Application No. PCT/IB2022/059822, Jan. 24, 2023.

*Primary Examiner* — Michael L Sehn
(74) *Attorney, Agent, or Firm* — Gottlieb, Rackman & Reisman, PC

(57) ABSTRACT

A blade for an industrial axial fan includes an airfoil, extending along a blade axis and having a leading edge, a trailing edge, a root side, a tip side; and a rod, having a first end connected to the airfoil and a second end protruding from the airfoil for coupling to a hub. The root side has a rounded contour with a concave stretch adjacent to the leading edge and a convex stretch adjacent to the trailing edge. A root end of the leading edge protrudes with respect to the insertion point toward the second end of the rod in a direction parallel to the blade axis. The airfoil forms a lobe that extends in the direction parallel to the blade axis toward the second end of the rod more than with respect to the root end of the leading edge. The airfoil is extruded or pultruded and the leading edge is rectilinear and parallel to the blade axis.

14 Claims, 4 Drawing Sheets

(51) Int. Cl.
*F04D 29/28* (2006.01)
*F04D 19/00* (2006.01)

(56) References Cited

U.S. PATENT DOCUMENTS

| | | | | |
|---|---|---|---|---|
| 10,036,392 | B2 * | 7/2018 | Gallina | F04D 19/002 |
| 2004/0258531 | A1 * | 12/2004 | Zeng | F04D 29/384<br>416/238 |
| 2011/0240268 | A1 | 10/2011 | Moore | |
| 2020/0049166 | A1 * | 2/2020 | Mosiewicz | F04D 29/384 |

* cited by examiner

BLADE FOR A LOW-NOISE INDUSTRIAL AXIAL FAN, INDUSTRIAL AXIAL FAN AND PROCESS FOR MANUFACTURING A BLADE OF AN INDUSTRIAL AXIAL FAN

CROSS-REFERENCE TO RELATED APPLICATIONS

This patent application claims priority from Italian Patent Application No. 102021000026387 filed on Oct. 14, 2021, the entire disclosure of which is incorporated herein by reference.

TECHNICAL FIELD

The present invention relates to a blade for a low-noise industrial axial fan, an industrial axial fan, and to a process for manufacturing a blade of an industrial axial fan.

BACKGROUND

As is known, an industrial axial fan generally comprises a hub and multiple blades that extend basically in a radial direction from the hub.

The hub rotates around an axis and is connected to an electric motor to receive rotary motion via a transmission system.

The blades are provided with an airfoil, so that, due to the rotation given by the motor, a difference in pressure is generated between the extrados and the intrados of the blades. In turn, the pressure difference produces an airflow in a direction substantially parallel to the axis of the hub.

The airflow that is set in axial motion depends on various factors, including, mainly, the rotation speed, the shape of the airfoil, and the coupling angle of the blades.

A phenomenon often associated with axial fans is the generation of noise levels that are often annoying, which it would be preferable to eliminate or at least reduce. The noise is mainly caused by air turbulence in turn produced by the rotation of the blades and is influenced by a variety of factors. For example, the rotation speed and the shape of the blades have a rather clear influence on the noise generation. A solution for attenuating the fan noise consists in reducing the rotation speed, increasing, at the same time, the dimensions of the blades to keep the required work flow. In general, in addition, the edges and ends of the blades may be shaped so as to accompany or protect the flow in the critical zones and reduce the formation of turbulence.

If similar solutions may, in principle, be exploited with advantage in the small and medium-sized fans, the blades of which are usually made by moulding, the same is not true for large fans, normally with a diameter of no less than a meter. In fact, the manufacturing processes for the large industrial fan blades are based on extrusion and/or pultrusion techniques, which are cost-effective, as well as providing satisfactory characteristics of lightness and mechanical strength to products, while the use of moulding techniques is normally precluded mainly because the cost is too high. On the other hand, the extrusion and pultrusion techniques entail specific issues because the products that can be obtained cannot be freely shaped. The products of extrusion and pultrusion using dies have, in fact, a hollow structure that is basically uniform and straight, which cannot be easily deformed, curved, or bent. In these cases, to reduce the noise level, typically the rotation speed is reduced and, simultaneously, the width of the blade is increased. In any case, the impossibility of shaping the blades obtained with these production technologies prevents significantly lowering the noise generated. As mentioned, the issue is typical of large industrial fans, while the smaller fan blades may be manufactured with different and more flexible techniques, like moulding.

SUMMARY

It is thus an aim of the present invention to provide an industrial axial fan that allows to overcome the limitations described and, in particular, allows to reduce noise levels.

According to the present invention, a blade for an industrial axial fan is provided comprising:

- an airfoil, extending along a blade axis and having a leading edge, a trailing edge, a root side, a tip side, an intrados, and an extrados; and
- a rod, having a first end connected to the airfoil at an insertion point through the root side and a second end protruding from the airfoil for coupling to a hub;
- wherein the root side has a rounded contour with a concave stretch adjacent to the leading edge and a convex stretch adjacent to the trailing edge;
- wherein a root end of the leading edge protrudes with respect to the insertion point toward the second end of the rod in a direction parallel to the blade axis;
- and wherein the airfoil forms a lobe at a junction between the trailing edge and the root side and the lobe extends more in the direction parallel to the blade axis toward the second end of the rod than with respect to the root end of the leading edge;
- and wherein the airfoil is extruded or pultruded and wherein the leading edge is rectilinear and parallel to the blade axis.

The form projecting from the leading edge and the lobe enable the reduction in turbulence at the root side and, as a result, in noise. The leading edge and the lobe at the trailing edge stretch outwards, in fact, towards the end of the rod that connects to the hub, i.e., towards the inside of the fan once the blade has been mounted. In practice, the form of the airfoil is such that, in use, the lobe of each blade can be overlapped with the leading edge of the successive blade in the rotation direction, protecting it from turbulence that is naturally generated by the trailing edge and by the recirculation at the root and thus significantly reducing the noise level, even by several decibels. The percentage of overlap between one blade and the other depends on the cord/width of the profile, the number of blades, and the size of the hub. For example, with a low number of blades, the percentage of overlap may be minimal or zero, but also in these specific cases, a benefit in terms of noise reduction is noted in any case.

The form of the airfoil, which is responsible for reducing the noise, may be easily obtained by cutting an extruded section bar (for example made of aluminium) or pultruded section bar (for example made of fibreglass). On the one hand, thus, the blade according to the invention is effective at reducing noise and allows to obtain results comparable with those of blades manufactured using moulding techniques. On the other hand, the blade according to the invention may be manufactured with much less costly processes like extrusion or pultrusion, followed by shaping by means of cutting.

Advantageously, the leading edge can be directly defined by a margin of the extruded or pultruded airfoil.

According to one aspect of the invention, the concave stretch and the convex stretch are joined without corners.

The absence of corners favours a flow without turbulence.

According to one aspect of the invention, the trailing edge is rounded at least in a portion adjacent to the root side.

According to one aspect of the invention, the trailing edge joins the convex stretch of the root side without corners.

At the trailing edge too, the rounded form without corners contributes to reducing the formation of vortices and, thus, of noise.

According to one aspect of the invention, the airfoil comprises a hollow first portion and a second portion in the form of a lamina that extend adjacent to each other from the root side to the tip side and wherein the first portion defines the leading edge and the second portion defines the trailing edge.

The first portion of the airfoil allows to give the desired form to the intrados and to the extrados, so as to obtain the required aerodynamic effect for each specific application. The second portion is in the form of a lamina and may be easily cut to define the trailing edge in accordance with project preferences.

According to one aspect of the invention, at least in one region around a maximum cord point the trailing edge is bent toward the extrados.

The trailing edge shaped thus accompanies the exiting flow and contributes, additionally, to reducing turbulence that could generate noise.

According to one aspect of the invention, the blade comprises a terminal member arranged to close the tip side of the airfoil and tapered toward the outside in the direction of the blade axis.

In particular, the terminal member has an inner face, coupled to the airfoil and having a first area, and an outer face, opposite the inner face and having a second area smaller than the first area.

The tapering towards the outside of the terminal member reduces the surface directly facing the retaining ring that is usually present around the rotor of the large axial fans. This technique contributes to additionally reducing the noisiness of the fan.

According to one aspect of the invention, the terminal member has an intrados face and an extrados face, joined to the outer face with respective rounded edges.

According to one aspect of the invention, the terminal member, in a plan view, is rounded at the leading edge.

According to the present invention, an industrial axial fan is also provided that comprises a hub that rotates around a rotation axis and multiple blades as defined above and coupled to the hub.

According to one aspect of the invention, the lobe of each blade, in a plan view, overlaps the root end of the leading edge of an immediately subsequent respective blade according to a rotation direction.

The position of the blades in the fan exploits the shape of the airfoil with the root end of the leading edge and the lobe that extend towards the hub in relation to the insertion point of the rod. In practice, with the arrangement and the shape of the blades defined thus, the conditions of the flow encountered by each blade are improved since the turbulence generated is deviated and/or reduced and, as a result, the noise is reduced, even by several decibels.

According to one aspect of the invention, the concave stretch of the root side of each blade is circular with a first radius equal to an outer radius of the hub and the convex stretch is circular with a second radius smaller than the first radius.

The outer radius of the hub may be defined by an anti-recirculation disk or by a part of a casing, such as a cap or ogive. The circular form of the concave stretch of the root side, with a radius basically corresponding to any play in the outer radius of the hub, avoids the formation of vortices between the airfoil and the hub itself.

According to one aspect of the invention, in each blade the lobe extends parallel to the respective blade axis until the rotation axis.

According to the present invention, a process for manufacturing a blade of an industrial axial fan is also provided, comprising:

- by extrusion or pultrusion, forming a section bar extending along an axis and having an airfoil section with a leading edge, an intrados, and an extrados;
- cutting the section bar transversely to the axis so as to define a tip side and a root side having a rounded contour with a concave stretch adjacent to the leading edge and a convex stretch; and
- inserting a first end of a rod at an insertion point through the root side in the concave stretch;
- wherein cutting comprises shaping the root side so that a root end of the leading edge protrudes with respect to the insertion point toward the second end of the rod in a direction parallel to the blade axis and so that the airfoil forms a lobe that extends in the direction parallel to the blade axis toward the second end of the rod more than the root end of the leading edge.

The process is simple and inexpensive, especially if compared to the manufacturing processes for moulding, but also entails producing blades with reduced noise levels.

BRIEF DESCRIPTION OF THE DRAWINGS

The present invention will now be described with reference to the accompanying drawings, illustrating some non-limiting embodiments thereof, in which.

DESCRIPTION OF EMBODIMENTS

The invention described below is especially adapted to the production of large axial fans, for example for heat exchangers used in natural gas liquefaction plants, refineries, or plants producing combined-cycle, turbine, or steam electricity.

Figure 1:
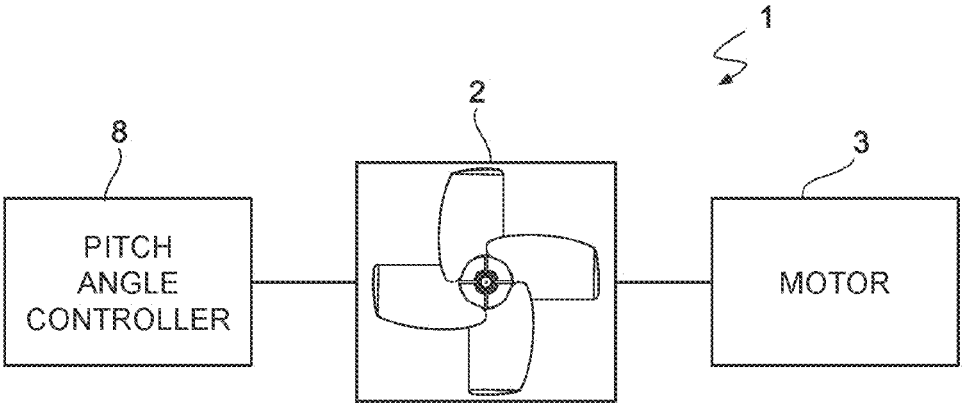
FIG. 1 shows a simplified block diagram of an axial fan according to a first embodiment of the present invention.

With reference to FIG. 1, a fan assembly, indicated overall with the reference number 1, comprises an axial fan 2 driven by an electric motor 3.

Figure 2:
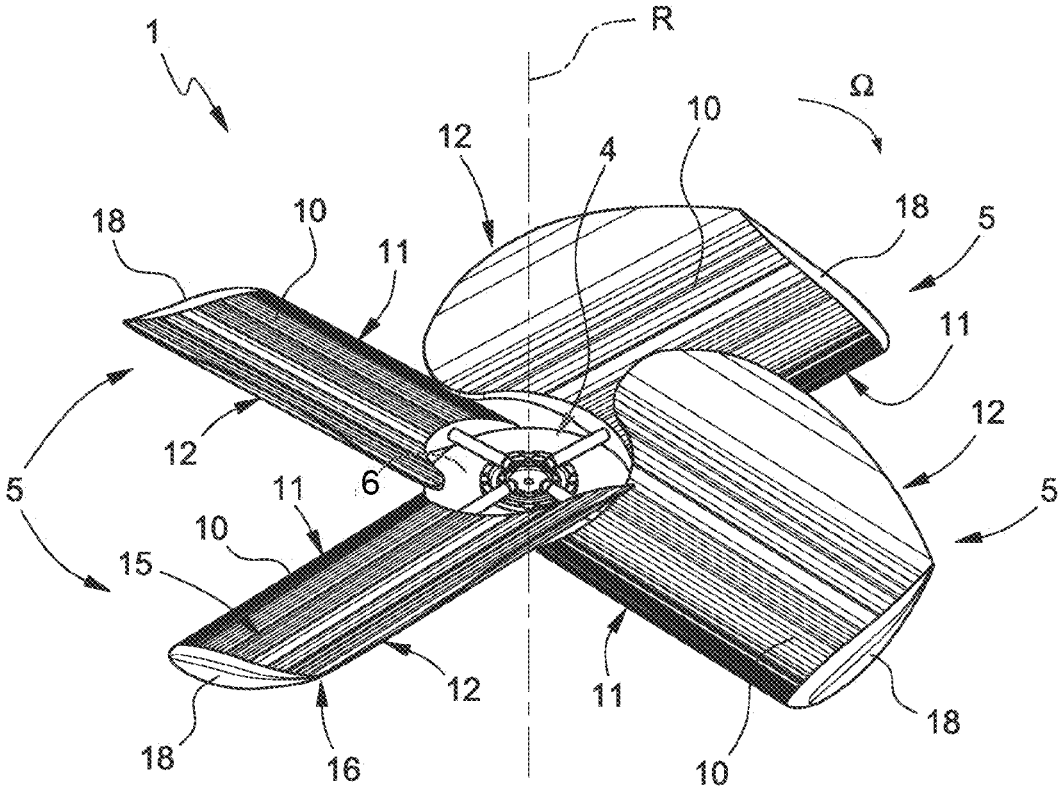
FIG. 2 is a perspective view of the axial fan in FIG. 1.
Figure 3:
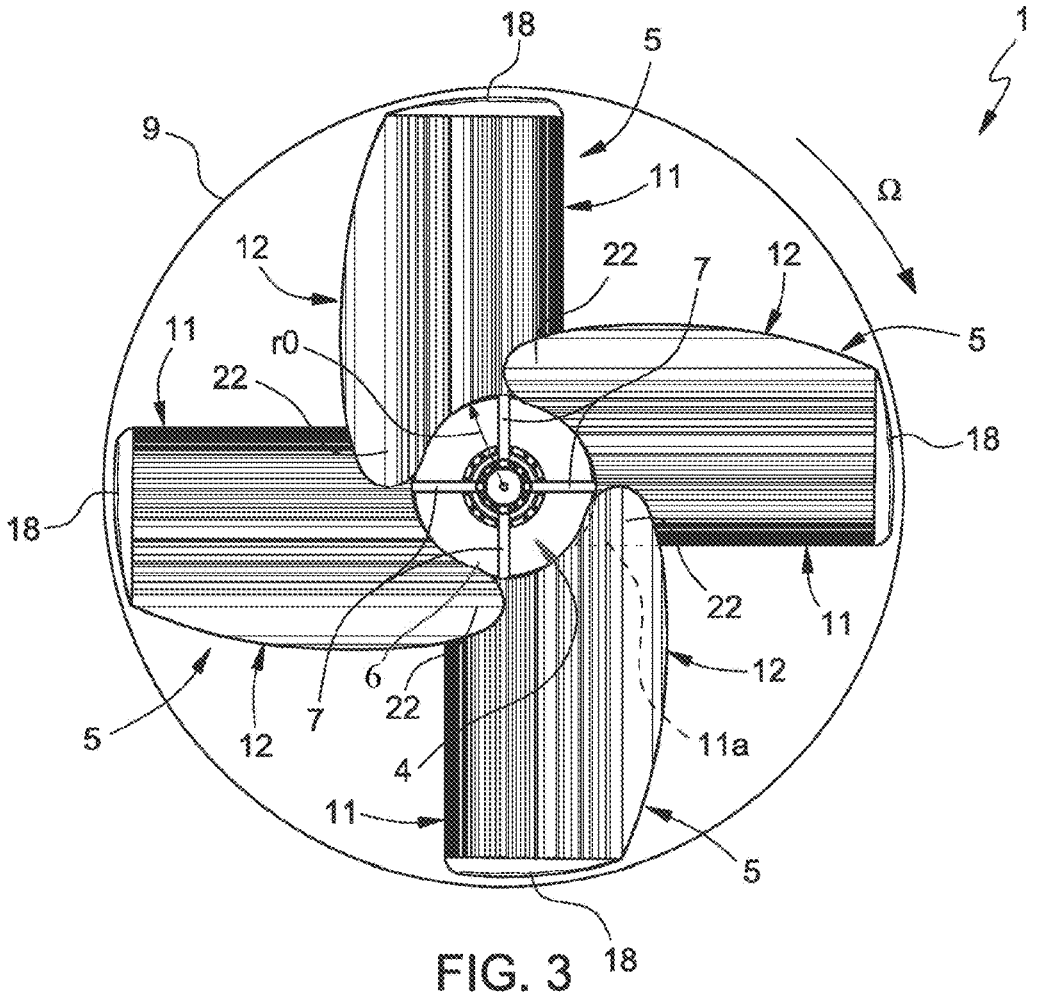
FIG. 3 is a plan view from above of the axial fan in FIG. 1.

The axial fan 2, which is represented in more detail in FIGS. 2 and 3, comprises a hub 4 connected to an electric motor 3 shaft, and multiple blades 5 that extend from the hub 4 basically in a radial direction. The hub 4 can swivel around a rotation axis R and has an outer radius r0 that, in the example illustrated, is defined by an anti-recirculation disk 6. Alternatively, the hub can be provided with a cover, like a cap or ogive, which define the outer radius.

The blades 5 are produced by extrusion or pultrusion, for example in aluminium, plastic, or fibreglass. The blades 5 are also connected to the hub 4 via respective rods 7. In one embodiment, the rods 7 can be oriented around respective longitudinal axes to enable the adjustment of a pitch of the blades 5 using a special adjuster 8 (FIG. 1). A retaining ring 9 is schematically illustrated in FIG. 3.

Figure 4:
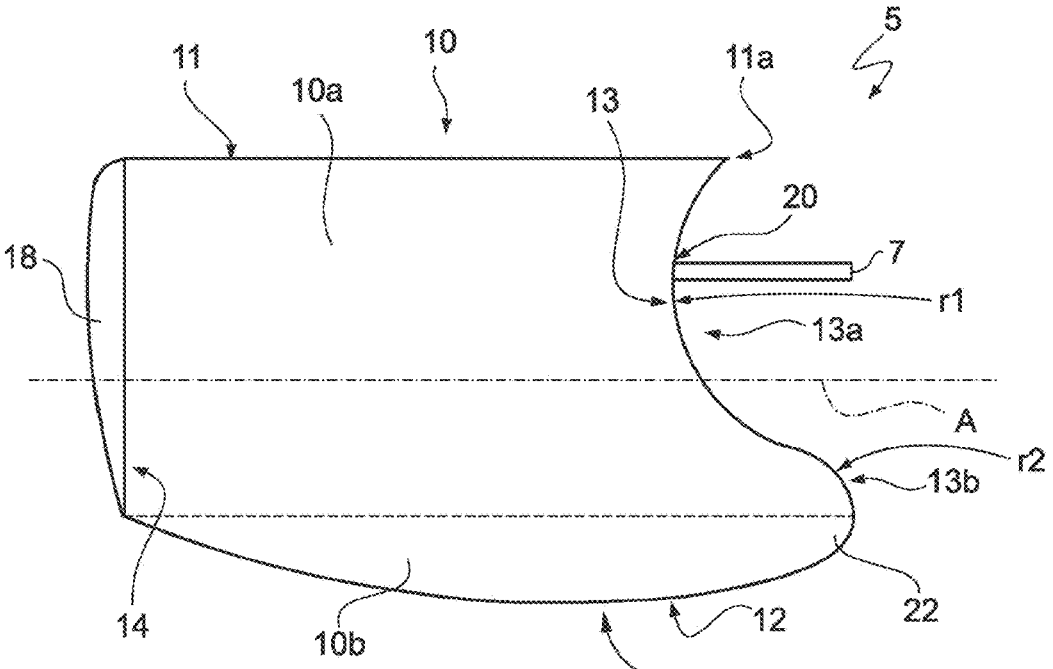
FIG. 4 is a plan view from above, enlarged, of a blade of the fan in FIG. 1.
Figure 5:
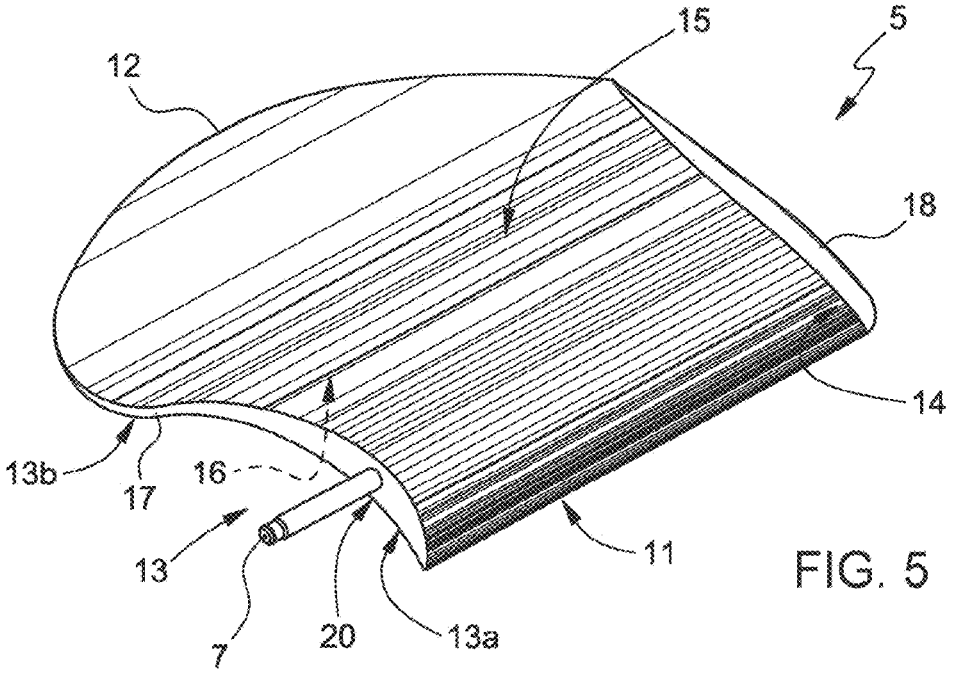
FIG. 5 is a perspective view of the blade in FIG. 4.

As also shown in FIGS. 4 and 5, each blade 5 comprises an airfoil 10, whether extruded or pultruded, extending along a blade axis A and having a leading edge 11, a trailing edge 12, a root side 13, and a tip side 14, an intrados 15 and an extrados 16. The airfoil 10 comprises a hollow first portion 10*a* and a second portion 10*b* in the form of a lamina, which extend longitudinally adjacent on the root side 13 to the tip side 14. The first portion 10*a* defines the leading edge 11, while the second portion 10*b* defines the trailing edge 12. On the root side 13, the first portion 10*a* of the airfoil 10 is closed by a mask 17. A terminal member 18 is arranged to close the tip side 14. A corresponding rod 7 has a first end connected to the airfoil 10 at an insertion point 20 through the root side 13 and a second end protruding from the airfoil 10 for coupling to a hub 4.

The leading edge 11 is rectilinear and parallel to the blade axis A.

Figure 6:
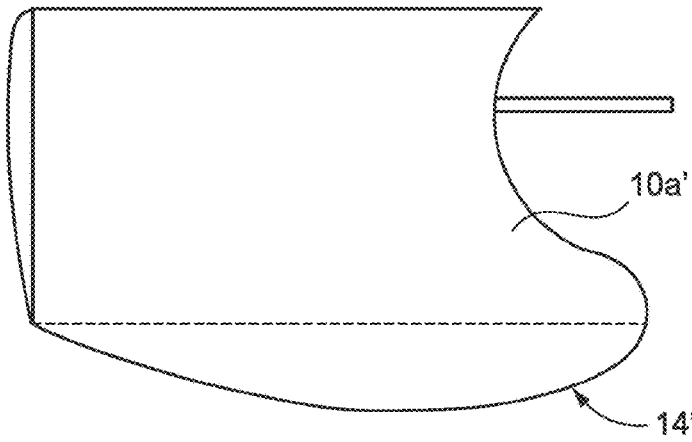
FIG. 6 is a plan view from above of a blade of an industrial axial fan according to a different embodiment of the present invention.
Figure 7:
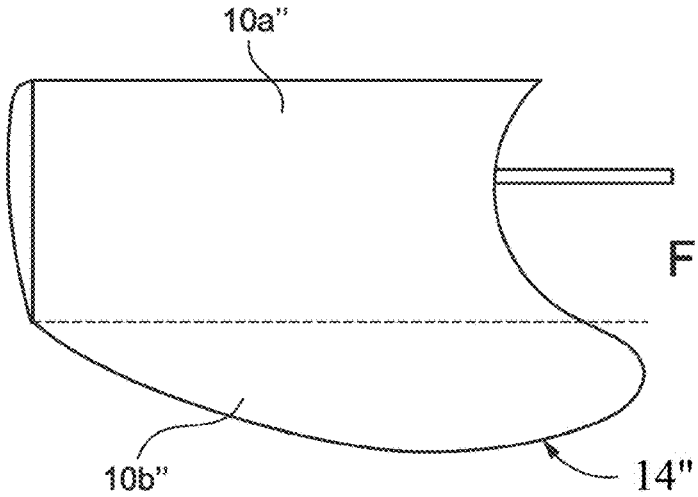
FIG. 7 is a plan view from above of a blade of an industrial axial fan in accordance with an additional embodiment of the present invention.

In one embodiment, the trailing edge 12 is defined in the second portion 10*b* of the airfoil 10 between joints between the first portion 10*a* and the second portion 10*b* at the root side 13 and at the tip side 14. In other embodiments, in any case, the trailing edge may also comprise a stretch of the first portion of the airfoil (respectively 14' and 10*a*' in FIG. 6); or the trailing edge may start in a stretch of the outline of the second portion not adjacent to the first portion (respectively 14", 10*b*", and 10*a*" in FIG. 7).

In any case, the trailing edge 12 is rounded at least in a portion adjacent to the root side 13. In the embodiment in FIG. 4, the trailing edge 12 is rounded along its whole length. In embodiments not illustrated, in any case, a radially outer portion of the trailing edge 12 may be straight or have a bend. The trailing edge 12 preferably does not have any corners.

The root side 13 and the tip side 14 are opposite each other and extend from the leading edge 11 to the trailing edge 12 transversely to the blade axis A.

The root side 13 has a rounded contour with a concave stretch 13*a* adjacent to the leading edge and a convex stretch 13*b* adjacent to the trailing edge 12. The concave stretch 13*a* and the convex stretch 13*b* are joined together without corners, potentially with the interposition of a straight stretch. The insertion point 20 of the rod 7 is in the concave stretch 13*a*, for example, at a point of minimal distance from the tip side 14.

The concave stretch 13*a* is shaped so that a root end 11*a* of the leading edge 11 protrudes with respect to the insertion point 20 toward the end of the rod 7 connected to the hub 4 in a direction parallel to the blade axis A.

In one embodiment, the concave stretch 13*a* of the root side of each blade is circular with a first radius r1 equal to an outer radius of the hub 4, potentially with some play, and the convex stretch 13*b* is circular with a second radius r2 smaller than the first radius r1.

The trailing edge 12 joins the convex stretch 13*b* of the root side 13 without corners. In particular, at a joint between the trailing edge 12 and the root side 13, the airfoil) forms a rounded lobe 22 that extends in a direction parallel to the blade axis A towards the end of the rod 7 that is more connected to the hub 4 than to the root side 11*a* of the leading edge 11. More precisely, as shown in FIG. 3, the lobe 22 of each blade 5 overlaps, in a plan view, the root end 11*a* of the leading edge 11 of an immediately subsequent respective blade 5 according to a rotation direction Ω, so as to protect against turbulence. In the embodiment illustrated here, in particular, the lobe 22 of each blade 5 extends parallel to the respective blade axis A to the rotation axis R.

The percentage of overlap between one blade and the other may depend on features such as the cord/width of the profile, the number of blades, and the size of the hub, and, in some embodiments not shown, may be zero. In the cases in which geometrically the overlap, in a plan view, is greatly reduced or zero, a benefit in terms of noise reduction is, in any case, noted. In a region around a maximum cord point 25, the trailing edge 12 is bent towards the extrados 16 so as to accompany the exiting flow and reduce turbulence that could generate noise.

Figure 8:
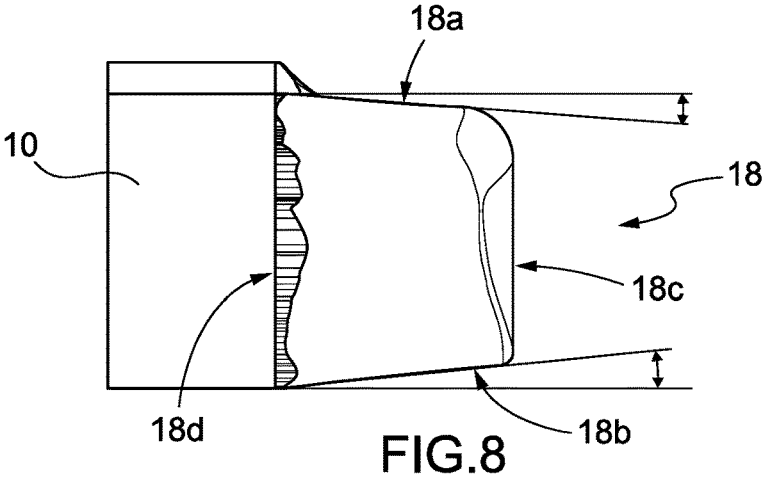
FIG. 8 is a front view of an enlarged detail of the blade in FIG. 4.

In each blade 5, the terminal member 18 is arranged to close the tip side 14 of the airfoil 10 and externally conforms with the retaining ring 9. A front portion of the terminal member 18, near the leading edge 11, is rounded in plan. The terminal member 18 is also tapered towards the outside in the direction of the blade axis A, as shown in FIG. 8. In practice, the terminal member has an intrados face 18*a* and an extrados face 18*b*, which decline towards each other and are joined at an outer face 18*c* with respective rounded corners. The outer face 18*c* has, thus, a smaller area than an inner face 18*d* of the terminal member 18 opposite and coupled to the airfoil 10.

Figure 9:
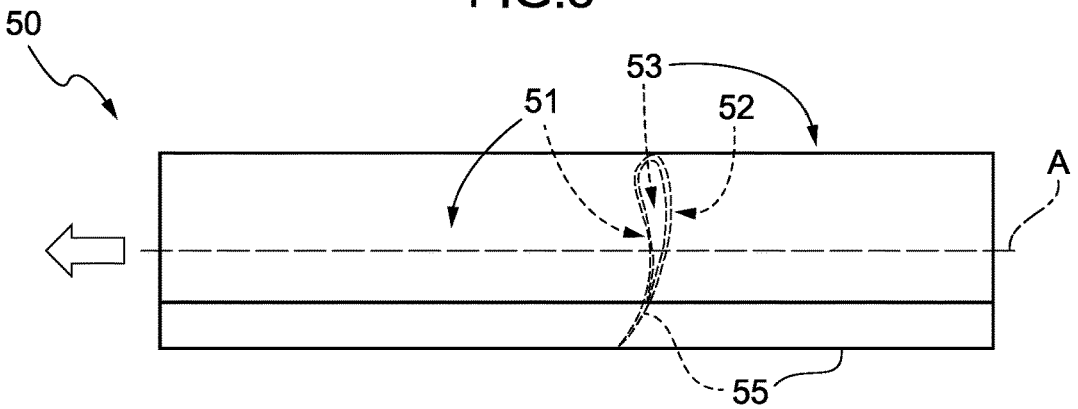
FIG. 9-11 show successive steps of a process for manufacturing a blade of an industrial axial fan in accordance with an embodiment of the present invention.
Figure 10:
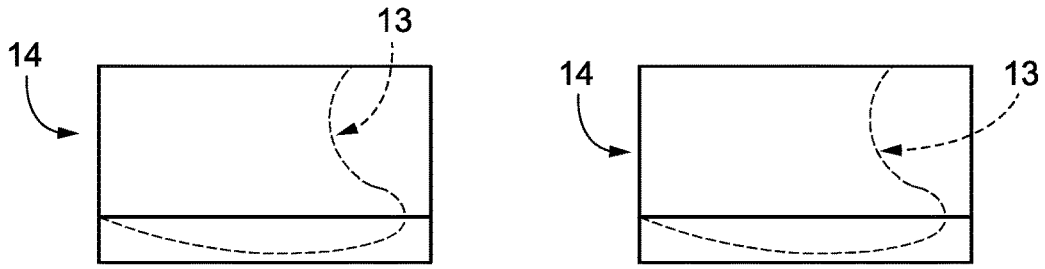
Figure 11:
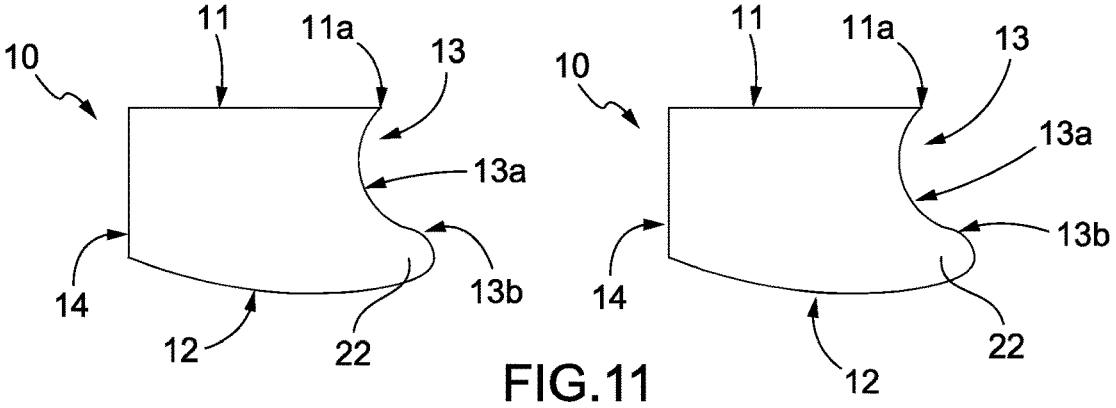

The blades 5 may be manufactured with the process described below with reference to FIGS. 9-11.

Initially (FIG. 9), a section bar 50 is extruded (for example if manufactured in aluminium) or pultruded (if manufactured in fibreglass) along an axis A, which will then form the blade axis. The section bar 50 has the section of the airfoil 10 with an intrados 51 and an extrados 52. In addition, the section bar 50 comprises a hollow first portion 53 and a second portion 55 in the form of a lamina that extend adjacent to each other longitudinally.

The section bar 50 is cut transversely to the axis A (FIG. 10) so as to separate portions corresponding to each blade. In this step, the tip side 14 of each blade may already be defined.

The root side 13 is, in turn, cut to form the rounded contour 13 with the concave stretch 13*a* and the convex stretch 13*b*. In particular, the root side 13 is shaped so that the root end 11*a* of the leading edge 11 projects in relation to the direction opposite the tip side 14.

The second portion of the airfoil is then cut to form the trailing edge 12. In addition, the cut defines the lobe 22, which extends in the direction opposite the tip side 14 more than the root end 11*a* of the leading edge 11. The airfoils 10 of each blade are obtained thus (FIG. 11).

Finally, the rod 7 is inserted at the insertion point 18, fixed to the profile 10 via a connection system not shown, and the blade is completed with the mask 17 and the terminal member 18, to achieve the blade structure of FIGS. 4 and 5.

Lastly, it is clear that modifications may be made to the axial fan described herein, and variations produced thereof, without departing from the scope of the present invention, as described in the appended claims.

In particular, the diameter and number of the blades of the axial fan may vary in relation to what is described.

The connection between the blades and the hub may also differ from what is described. Among other things, the blades may be connected to the hub with a fixed pitch.

In addition, the blades may not have terminal members and/or brackets with an aerodynamic configuration, for example if not required for a specific application.

The invention claimed is:

1. A blade for an industrial axial fan comprising:

an airfoil extending along a blade axis and having a leading edge, a trailing edge, a root side, a tip side, an intrados and an extrados; and a rod having a first end connected to the airfoil at an insertion point through the root side and a second end protruding from the airfoil for coupling to a hub;

wherein the root side has a rounded contour with a concave stretch adjacent to the leading edge and a convex stretch adjacent to the trailing edge;

wherein a root end of the leading edge protrudes with respect to the insertion point toward the second end of the rod in a direction parallel to the blade axis;

wherein the airfoil forms a lobe at a junction between the trailing edge and the root side and the lobe extends in the direction parallel to the blade axis toward the second end of the rod more than with respect to the root end of the leading edge;

wherein the airfoil is extruded or pultruded and wherein the leading edge is rectilinear and parallel to the blade axis; and wherein the airfoil comprises a hollow first portion and a second portion in the form of a lamina, wherein the first portion and the second portion extend adjacent to each other from the root side to the tip side and wherein the first portion defines the leading edge and the second portion defines the trailing edge.

2. The blade according to claim 1, wherein the concave stretch and the convex stretch join each other without corners.

3. The blade according to claim 1, wherein the trailing edge is rounded at least in a portion adjacent to the root side.

4. The blade according to claim 1, wherein the trailing edge joins the convex stretch of the root side without corners.

5. The blade according to claim 1, wherein at least in a region around a maximum cord point the trailing edge is bent toward the extrados.

6. The blade according to claim 1, comprising a terminal member arranged to close the tip side of the airfoil and tapered toward the outside in the direction of the blade axis.

7. The blade according to claim 6, wherein the terminal member has an inner face, coupled to the airfoil and having a first area, and an outer face, opposite to the inner face and having a second area smaller than the first area.

8. The blade according to claim 7, wherein the terminal member has an intrados face and an extrados face, joined to the outer face with respective rounded edges.

9. The blade according to claim 6, wherein the terminal member is rounded at the leading edge in top view.

10. An industrial axial fan, comprising:

a hub rotatable about a rotation axis; and a plurality of blades coupled to the hub, each blade comprising: an airfoil, extending along a blade axis and having a leading edge, a trailing edge a root side, a tip side, an intrados and an extrados; and a rod, having a first end connected to the airfoil at an insertion point through the root side and a second end protruding from the airfoil for coupling to a hub;

wherein the root side has a rounded contour with a concave stretch adjacent to the leading edge and a convex stretch adjacent to the trailing edge;

wherein a root end of the leading edge protrudes with respect to the insertion point toward the second end of the rod in a direction parallel to the blade axis;

wherein the airfoil forms a lobe at a junction between the trailing edge and the root side and the lobe extends in the direction parallel to lade axis toward the second end of the rod more than with respect to the root end of the leading edge;

wherein the airfoil is extruded or pultruded and wherein the leading edge is rectilinear and parallel to the blade axis; and wherein the concave stretch of the root side of each blade is circular with a first radius equal to an outer radius of the hub and the convex stretch is circular with a second radius smaller than the first radius.

11. The axial fan according to claim 10, wherein, in top view, the lobe of each blade overlaps to the root end of the leading edge of an immediately subsequent respective blade according to a rotation direction.

12. The axial fan according to claim 10, wherein in each blade the lobe extends parallel to the respective blade axis until the rotation axis.

13. A process for manufacturing a blade of an industrial axial fan comprising the following steps:

by extrusion or pultrusion, forming a section bar extending along an axis and having an airfoil section with a leading edge, an intrados and an extrados;

cutting the section bar transversely to the axis so as to define a tip side and a root side having a rounded contour with a concave stretch adjacent to the leading edge and a convex stretch; and inserting a first end of a rod at an insertion point through the root side in the concave stretch;

wherein cutting comprises shaping the root side so that a root end of the leading edge protrudes with respect to the insertion point toward the second end of the rod in a direction parallel to the axis and so that the airfoil forms a lobe that extends in the direction parallel to the axis toward the second end of the rod more than the root end of the leading edge; and wherein the section bar comprises a hollow first portion and a second portion in the form of a lamina, wherein the first portion and the second portion extend longitudinally adjacent to each other and wherein the first portion defines the leading edge.

14. The process according to claim 13, comprising forming, from the second portion of the section bar, a trailing edge rounded at least in a portion adjacent to the root side.

* * * * *